US010589142B2

(12) United States Patent
Simpson et al.

(10) Patent No.: US 10,589,142 B2
(45) Date of Patent: Mar. 17, 2020

(54) MY FAMILY GYM

(71) Applicants: Richard Carl Simpson, Unionville, CT (US); Mary Dianne Simpson, Unionville, CT (US)

(72) Inventors: Richard Carl Simpson, Unionville, CT (US); Mary Dianne Simpson, Unionville, CT (US)

( * ) Notice: Subject to any disclaimer, the term of this patent is extended or adjusted under 35 U.S.C. 154(b) by 0 days.

(21) Appl. No.: 15/932,729

(22) Filed: Jul. 9, 2018

(65) Prior Publication Data

US 2020/0009415 A1 Jan. 9, 2020

(51) Int. Cl.

| | |
|---|---|
| ***A63B 21/00*** | (2006.01) |
| ***A63B 21/04*** | (2006.01) |
| ***A63B 21/16*** | (2006.01) |
| ***A63B 23/04*** | (2006.01) |
| ***A63B 23/02*** | (2006.01) |
| ***A63B 23/12*** | (2006.01) |
| ***A63B 23/035*** | (2006.01) |

(52) U.S. Cl.

CPC ..... *A63B 21/0442* (2013.01); *A63B 21/16* (2013.01); *A63B 23/0205* (2013.01); *A63B 23/0233* (2013.01); *A63B 23/03558* (2013.01); *A63B 23/0494* (2013.01); *A63B 23/1209* (2013.01); *A63B 2210/50* (2013.01)

(58) Field of Classification Search

CPC . A63B 21/0442; A63B 21/16; A63B 23/0205; A63B 23/0233; A63B 23/03558; A63B 23/0494; A63B 23/1209; A63B 2210/50

See application file for complete search history.

(56) References Cited

U.S. PATENT DOCUMENTS

| | | | | |
|---|---|---|---|---|
| 5,295,930 | A * | 3/1994 | Hogan | A63B 69/18 482/130 |
| 6,551,224 | B1 * | 4/2003 | Lim | A63B 23/0211 482/142 |
| 8,678,829 | B2 * | 3/2014 | Manfre | A63B 17/00 434/258 |
| 9,162,106 | B1 * | 10/2015 | Scheiman | A63B 23/08 |
| 2004/0067827 | A1 * | 4/2004 | Tustin | A63B 21/0004 482/121 |
| 2007/0238581 | A1 * | 10/2007 | Malazinsky | A63B 22/205 482/52 |

* cited by examiner

*Primary Examiner* — Steven O Douglas

(57) ABSTRACT

A functional triangular apparatus for multi-exercise of lower and upper extremities using resistance bands encircling designated parts. When exercising legs the triangular apparatus is stationary or tilted back at various angles to balance on two feet. Arms exercise with stretch bands under elevated larger base while feet hold it down.

2 Claims, 4 Drawing Sheets

MY FAMILY GYM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

Figure 1:
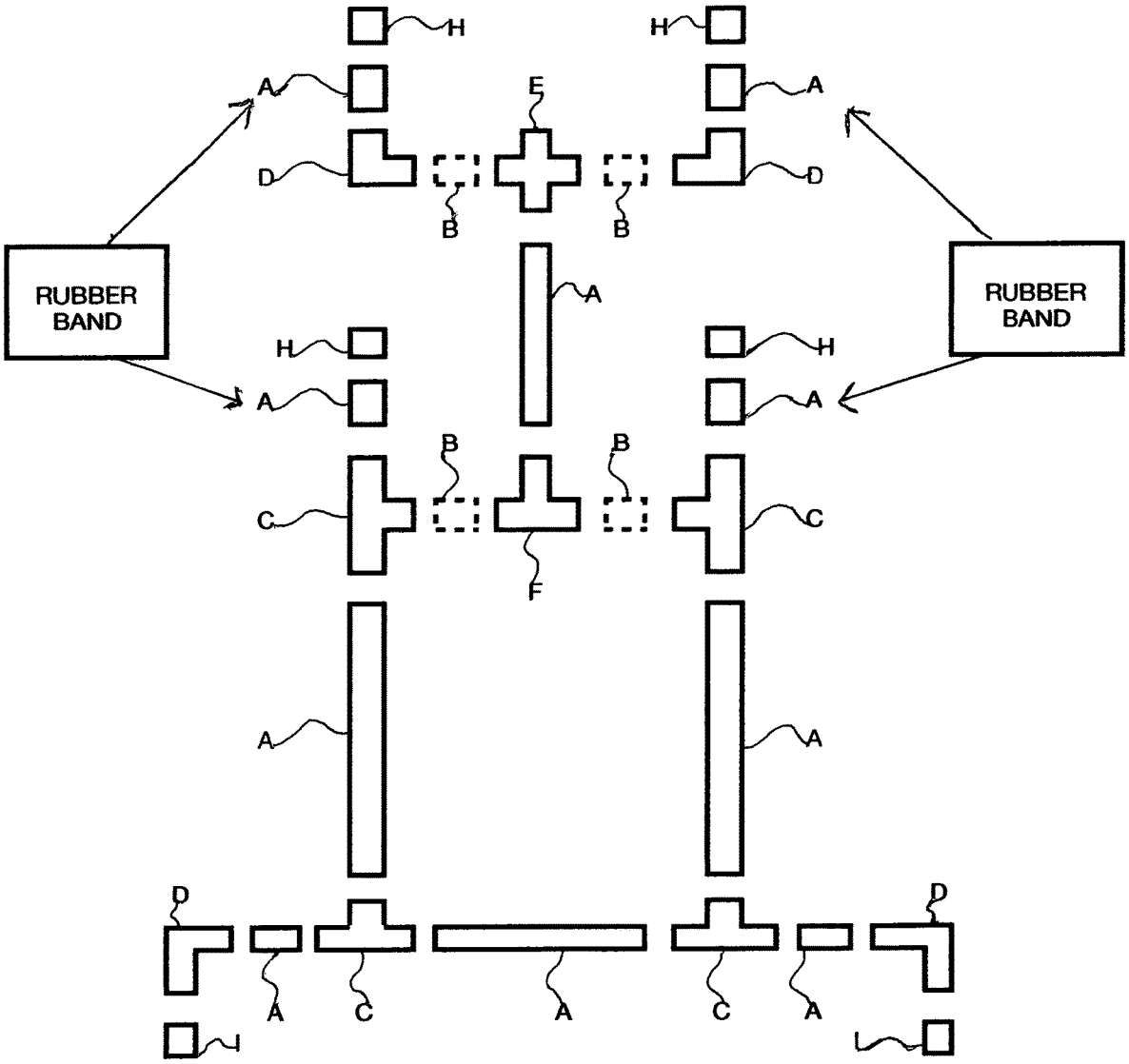

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Cardinal Intellectual Property Inc. completed a patent search. Domain names acquired. Website was developed and revised. No sales have been executed to date.

BACKGROUND OF THE INVENTION

(1) Field of the Invention—Technical Field

A functional apparatus for multi-exercise of lower and upper extremities while sitting using circular resistance bands encircling the apparatus at the upper, middle and lowest horizontal traverse. Legs exercise with apparatus stationary on four feet of two horizontal base's or with apparatus pulled back to balance on two feet of largest base. Arms use stretch bands encircling the largest base for multi-exercises with feet holding base down. Proper use of functional apparatus for multi-exercise improves muscle strength of the entire body including upper and lower extremities and body core muscles. Under ten pounds the apparatus fits in a 21 inch duffel bag after disassembly.

(2) Description of Related Art Including Information Disclosed Under 37 CFR 1.97 and 1.98

Following is a listing of related U.S. Pat. Documents:

| | | |
|---|---|---|
| US9,579,535 | Feb. 28, 2017 | Markowitz |
| US6,908,418 | Jun. 21, 2005 | Saure |
| US8,715,146 | May 6, 2014 | Balanced Body, Inc |
| US20140148316 | May 29, 2014 | Tsuchio |
| US7,128,699 | Oct. 31, 2006 | Chililon Enterprise Co. LTD |
| US9,314,658 | Apr. 19, 2016 | Arqex Outdoor Fitness System |
| US20050130814 | Jun. 16, 2005 | Nautilus, Inc |
| US5,997,448 | Dec. 7, 1999 | Duba |
| US7,226,402 | Jun. 5, 2007 | Joya |
| US5,645,516 | Jul. 8, 1997 | Foster |
| US5,112,287 | May 12, 1992 | Brewer |
| US8,690,742 | Apr. 8, 2014 | Herman |

-continued

Following is a listing of related U.S. Pat. Documents:

| | | |
|---|---|---|
| US8,033,960 | Oct. 11, 2011 | con IP, Inc. |
| US8,465,401 | Jun. 18, 2013 | Ihli |
| US7,431,681 | Oct. 7, 2008 | St Cyr |
| US20150024911 | Jan. 22, 2015 | Exemplar Design, LLC |
| US6,299,569 | Oct. 9, 2001 | Retrograce Systems Inc. |
| US9,259,606 | Feb. 16, 2016 | Wolan |
| US8,821,359 | Sep. 2, 2014 | Bodylastic International, Inc. |
| US20120115692 | May 10, 2012 | Bussen |
| US20160082306 | Mar. 24, 2016 | Williams |
| US7,361,127 | Apr. 22, 2008 | Tremayne |

Remarks on Background Art

Lim U.S. Pat. No. 6,551,224 The user sits or reclines on removable pads, or stands leaning on apparatus. Sitting pad is 10 inches wide and reclining pad 14 inches wide. A design for persons of small stature it appears. Over 250 PVC connectors, and many pipes. Work to cut pipe, glue connection and assembly will be extensive. Most retail suppliers price connectors over $1.00. Lim PVC total cost will likely exceed $250. Some apparatus adjustments require for exercises. Device uses bungee cords as preferred elastics. Applicant's apparatus is a triangular apparatus which can be balanced on two feet when exercising. This is a feature unique to this apparatus and not used in prior art. Apparatus is used only by persons sitting in a chair of individual's choice. Apparatus not limited to individual of small stature. No mechanical changes to apparatus are required. Apparatus PVC connector and pipe costs under $30. With 14 connectors and 19 glue points applicant's apparatus labor cost to cut pipe, glue and assemble fewer apparatus pieces will be less than comparable prior art. Assembled apparatus has four nylon thumbscrew connections to disassemble quickly into 4 sections to fit in a duffle bag for storage or transport. While a bungee cord could be used a 4 inch wide elastic stretch band is preferred band for applicant's apparatus. Wider elastic bands less likely to slip off feet making them safer.

Manfre U.S. Pat. No. 8,678,829 Device with over 70 PVC parts means more cost and work for glue and assembly. Primarily a physical therapy device used by patient to grasp a conical tool to place on a target protruding vertically and horizontally from the standing structural member. It appears apparatus is limited to hand and arm therapy. Stretch bands not used with this device. Applicant's apparatus fewer PVC connectors has less work and cost for PVC, glue and assembly work. Using stretch bands both upper and lower extremity exercise on applicant's apparatus.

Mankovitz U.S. Pat. No. 5,921,900 The apparatus for attachment to an office chair is limited to leg exercises; and user must stand to change resilient members. Applicant apparatus is used sitting exercise of muscles in legs, legs, and core. Changing applicant's apparatus are not necessary. Different strength stretch bands can be used.

Malazinsky U.S. Pat. No. 7,481,745 Device is for aquatic stair stepper exercise with feet on extension legs using resistance bands; while floating with arms on the supporting bars. Applicant's apparatus is a light, easy to assemble, standing structure used while sitting in a chair of choice at home. Device has more options for exercise of upper and lower extremities, plus core muscles; and needs small space.

Scheiman U.S. Pat. No. 9,162,106 is an apparatus only used only for leg and foot exercise with resistance bands attached to the apparatus while sitting in a chair. Applicant's apparatus is mobile, light, easy to assemble 4 part structure which provides more options for exercise of both upper and lower extremities, plus core muscles.

Hogan U.S. Pat. No. 5,295,930 Is an apparatus for a person standing on an elongated support member attached to base apparatus simulating pivotal swaying like downhill skiing by user pushing down and lateral. Other person can push while user is holding onto vertical member of base. Applicant's apparatus is a light weight and easy to assemble standing structure used while seated. Apparatus can tilt back to provide many varied angles for exercise of lower extremities and core muscles. Arms exercise done with stretch bands under stationary elevated largest base with feet holding base down. Second individual is not involved with exercise of applicants apparatus. Apparatus is light weight under 10 pounds.

Tustin US2004/0067827 is a continuous elastic natural gum rubber band in a closed loop. With no rigid structure or anchor it is an unaided, and possibly more hazardous exercise if elastic slips off hand, arms, legs or feet. User must stand for exercise if elastic attached to door. Applicant's apparatus as anchor is safer for exercises while seated at home in a chair of choice.

Wolan U.S. Pat. No. 9,259,606 Apparatus uses resistance bands with exercise machine that includes a low platform with a pair of arms attached. Arms may extend laterally away from the platform with resistance bands attached. Standing on the platform or on straps individuals use resistance bands for exercise. Arms may further pivot relative to the platform to perform a plurality of different exercises. Applicant's triangle apparatus can be used stationary on four feet, or it can be tilted at different angles to balanced on two feet of largest base for leg exercises. Also numerous exercises of upper extremities are possible using stretch bands encircling the large transverse base of main framework nearest the user.

BRIEF SUMMARY OF THE INVENTION

A functional triangle shaped multi-use exercise device made using one inch PVC polyvinyl chloride. The main framework is made with two long pipes angled 45 degrees inward mounted on a large horizontal base, and one long pipe from a 45 degree connector to a smaller horizontal parallel support base. With all parts on plane a middle horizontal traverse and a third higher horizontal traverse completes the main framework.

Following a medically prescribed class for balance the instructor provided stretch bands for home use. Trying circular bands by hand and looking for useful commercial devices led to developing an alternative apparatus using PVC materials. After many prototypes My Family Gym was developed as a practical anchor to use with elastic bands while sitting in chair at home. Tall, small, old or young, individual can exercise on apparatus.

Elastic stretch bands are available in a variety of strengths from light pull strength to stronger 25-50 pound pull. After consulting with a personal doctor a user can start with light resistance and increase strength up 4-5 levels as muscles get stronger. Longer stretch bands can be used for upper extremity exercises by encircling the lowest horizontal transverse base. With feet in elastic bands anchored at selected points on the middle or upper traverse the individual pushes legs and feet down and away at preferred manner and pace. This push away action makes apparatus safer for leg exercises compared to exercises done with feet in a non-anchored elastic band. The larger low traverse base is used for arm exercises and for safety two tees spaced apart make an enclosed width of 10 inches at middle of main framework.

BRIEF DESCRIPTION OF SEVERAL VIEWS OF DRAWING(S)

FIG. 1—Main vertical framework section shown with one inch PVC (polyvinyl chloride) individual pipes A, 4 small imbedded pipes B, 10 PVC connectors (C,D,E,F), plus 2 rubber feet I. The larger lowest traverse base, middle traverse, and highest horizontal transverse are points where stretch bands are encircled for exercise. Main framework is all one plane approximately 45 degrees to rigid horizontal supporting surface.

Figure 2:
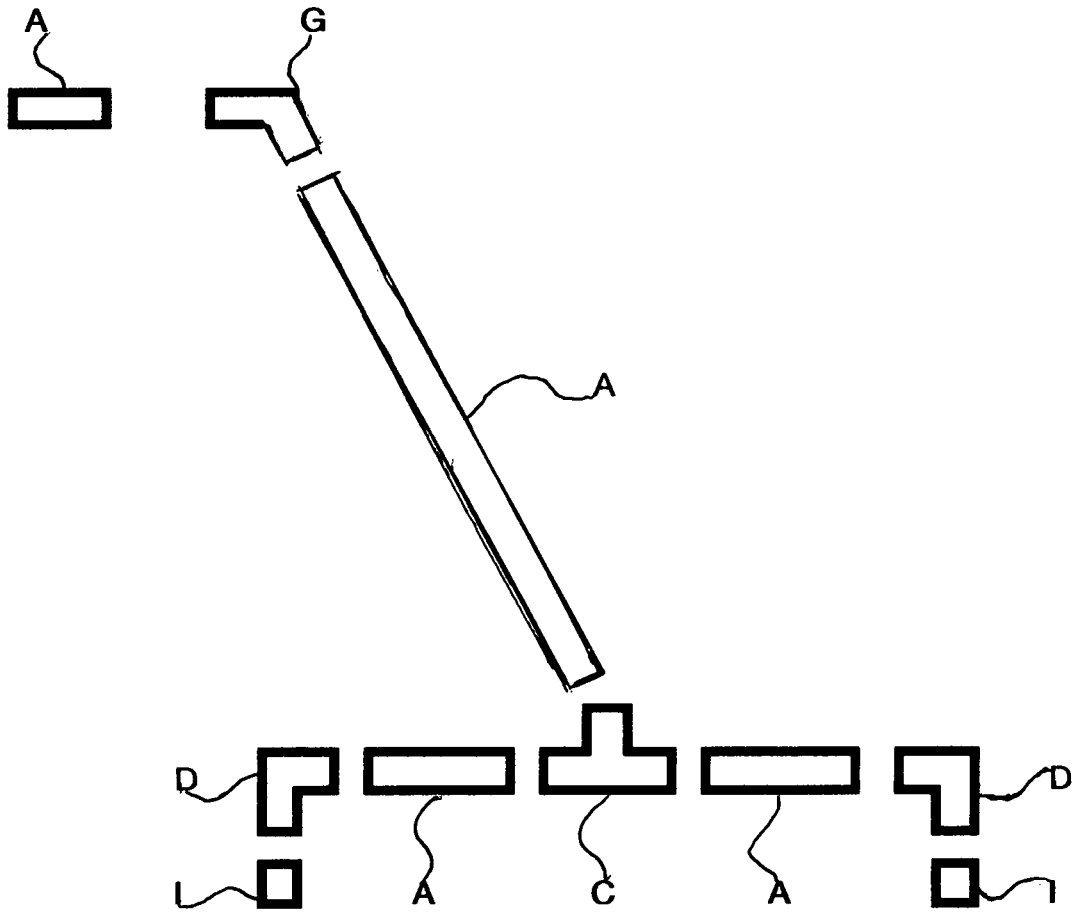

FIG. 2—Smaller horizontal support base is at 180 degrees to rigid horizontal support surface. Small base middle tee C horizontal parts comprise pipes A to two 90 degree connectors D, further comprise vertical parts with two unglued rubber feet I pointing to rigid horizontal support surface. Said small base middle tee vertical part slanted 45 degrees comprising elongated pipe A to 45 degree connector lower part G, further comprising 45 degree connector horizontal part to pipe A connecting to horizontal part of 4way connector F. Small base parallel to larger support base prevents total collapse when apparatus is balanced on two feet I of larger base for exercise.

Figure 3:
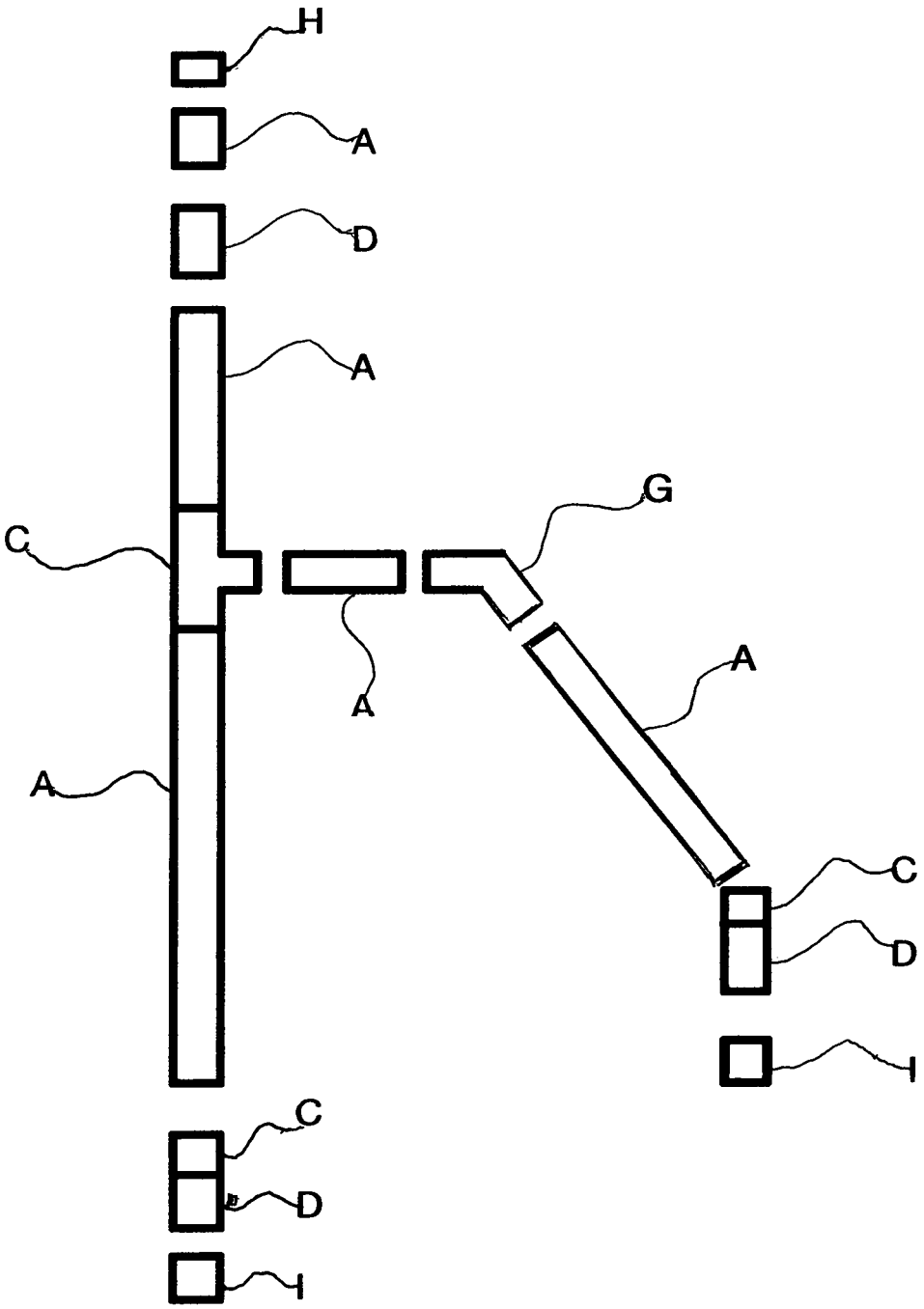

FIG. 3—Side view of main apparatus framework at vertical to rigid horizontal supporting surface with smaller front horizontal support base approximately 6 inches above rigid horizontal surface due to triangle shape. At rest the total height of apparatus approximately 36 inches off rigid horizontal support surface based on preferred size of all pipes A including non-glued upper pipes.

Figure 4:
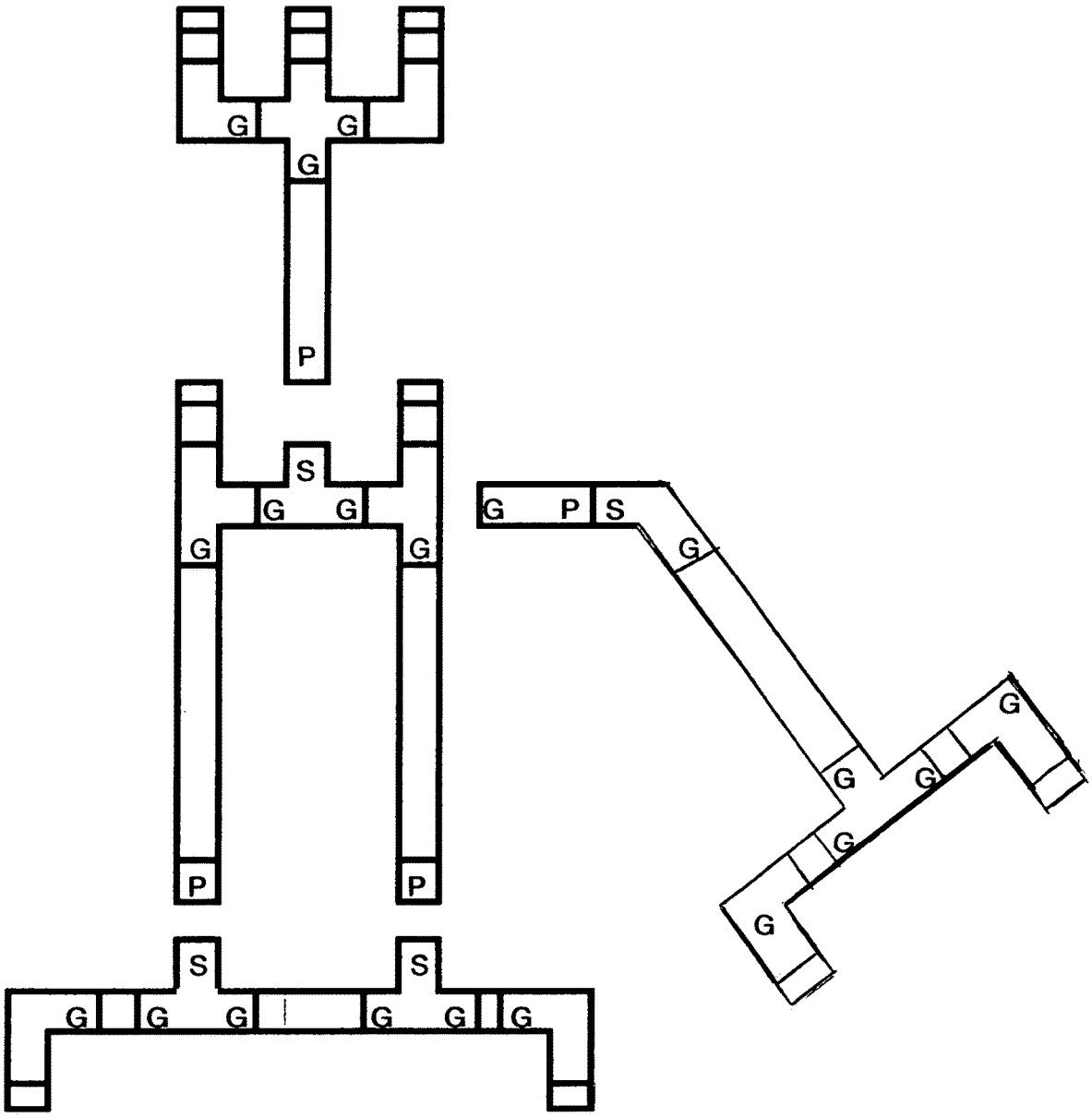

FIG. 4—Apparatus four sections disassembled at points where ¼ inch #20 nylon screw is used with imbedded bolt in solid PVC plug. Disassembled sections fit into a 21 inch duffle bad for storage or transport. S—¼" #20 nylon screw points, P—plug points for ¼" bolt imbedded in 1" solid PVC plug, G—glue points. Glue points showing where pipe inserted in connector and glue forms chemical weld to make solid joint.

DETAILED DESCRIPTION OF THE INVENTION

A triangle shaped functional multi-exercise apparatus, said triangle shaped functional multi-exercise apparatus comprise:

main framework seen in FIG. 1 all parts on vertical plane approximately 45 degrees vertical to a rigid supporting horizontal surface, said main framework comprise largest horizontal transverse support base, further comprise two tee horizontal parts C spaced apart, said horizontal tees parts further comprise pipes A to horizontal parts of two 90 degree ells D, said 90 degree ells D vertical support legs angled on plane pointing to rigid supporting horizontal surface, further comprise non-glued rubber feet I.

Said angled two tee base parts C above comprise two elongated connecting pipes A to two tee horizontal lower parts C at middle horizontal traverse, said middle horizontal traverse tees upper vertical parts C comprise non glued pipes to non glued caps H, said middle horizontal traverse comprise two tee base parts C abut 4way middle connector horizontal parts F using hidden pipe B, said 4way single horizontal part F comprise pipe A to 45 degree horizontal part G, further comprise 45 degree downward part to elongated connecting pipe A to small traverse middle tee C.

Said small traverse middle tee C horizontal parts comprise pipes C to 90 degree ells horizontal part D, said 90 degree ells vertical parts D point down 90 degrees to rigid supporting horizontal surface, further comprise non-glued rubber feet I.

Said middle 4way single vertical part F comprise pipe A to middle cross lower vertical part at elevated horizontal traverse, said middle cross horizontal parts abut horizontal parts of 90 degree ells by hidden pipe B, said 90 degree ells vertical upper part D on plane with main framework pointing approximately 45 degrees from rigid horizontal supporting surface, further comprise non glue pipe A to non glue caps I.

PURPOSE AND USE OF APPARATUS

A main purpose of the functional multipurpose exercise apparatus is as a portable apparatus to exercise legs, arms, and core with different elastic resistance bands.

Another purpose of the functional multipurpose exercise apparatus is to accommodate persons who cannot stand but must remain seated while performing exercise.

Area needed for apparatus for multiple muscle strengthening exercises is much smaller than many exercises devices.

Another purpose is to offer a low cost home exercise device.

In the preferred embodiment four ¼ inch #20 thumbscrews attach four sections of the apparatus making it easy to assemble and disassemble for storage or transport in a duffle bag.

After assembly the apparatus is lightweight under 10 pounds. The apparatus is easy to transport for elderly, partially disabled, or a convalescing patient.

Apparatus when assembled is approximately 36 inches high in the preferred embodiment. The larger horizontal base in the preferred embodiment is approximately 22 inches long. The small support horizontal base in the preferred embodiment is approximately 12 inches long. The main vertical is approximately 20 inches high at a angle of approximately 45 degrees in the preferred embodiment. Between large base and small base apparatus covers an area approximately 16 inches long. When the main framework is pulled back to a 90 degree vertical position the small traverse base is approximately 7 inches high above the rigid horizontal surface.

Apparatus Construction

1. Apparatus has approximately 94.5 inches of PVC pipe 3—17 inch, 1—9 inch, 1—6.5 inch, 2—5 inch, 3—3 inch, 4—2.25 inch,
   Imbedded 2.25 inch pipes—4, Imbedded solid PVC plugs—4 Apparatus has 14 total PVC connecting parts.
   5—tees, 6—90 degree ells, 1—45 degree ell, 1—cross, 1—4way, Optional caps on small pipes at exercise points—4
2. Non PVC parts
   1 inch rubber feet—4, Nylon thumbscrews—¼ inch #20—4 Imbedded ¼ inch bolts—4
3. Apparatus has 17 glued connections
4. Drill points for screws are positioned to avoid damage to stretch bands caused by snags or consistent abrasion.
   a. Screw points (s) inside tees of large support base of main framework vertical part pointing 45 degrees at user.
   b. Screw point (s) on center to avoid stretch band damage.
   b. Screw point (s) on 4way back center of vertical part.
   c. Screw point on top center of 45 ell horizontal part.

My Family Gym in the preferred embodiment is constructed using glue, or plastic welding, to join specific PVC connections to Schedule 40 1 inch PVC (Polyvinyl Chloride) pipes. One inch PVC pipe, connections, and glue are available at many hardware outlets. Four ¼ inch #20 thumbscrews are used to assemble the four main sections of apparatus. Optional pipe 4 or 6 inch long can be added to top part of the upper cross opening for taller individuals (over 6 foot) but no pipe is used in the preferred embodiment. The upper opening of the cross can also be modified as a holder for optional equipment such for MP3, I-phone, or timer.

PVC as preferred embodiment is lighter and cheaper than most other materials. Color infused in PVC basic formula will prevent changes in appearance due to fading from light, chipping or other abrasions.

The new and stable triangular configuration of one inch PVC is the preferred embodiment over other materials or dimensions. The construction of three transverse levels is also the preferred embodiment for use by persons of many different ages, sizes, physical abilities. Three levels permits the use for exercises of both legs and arms. This combination of triangular configuration and three tiers, or bars, is unique to this apparatus. In this apparatus the preferred embodiment is a four inch wide elastic resistance stretch bands of different strengths, but other elastic members such as bungee cords can be used. Other configurations or types of attachment might be used but four parts for this apparatus using an imbedded ¼ inch thumb screw is the preferred embodiment.

After consulting with a personal doctor a user can start with light resistance and increase strength up 4-5 levels as muscle get stronger. Some may want to start with a medium strength bands. The apparatus in the preferred embodiment has bands sized with approximate 4.5 foot circumference. Longer elastic bands up to 7 foot (or longer) can be tied to create a circular band for use with the lowest large horizontal base.

The apparatus is a light weight solid anchor designed for stretch bands. The push away action for leg exercises makes apparatus a safer exercise for stretch bands leg exercises compared to exercises done with hands and legs without an anchor. The lowest base traverse where arm or hand exercises pulling towards individual has a restrictive area in the middle to reduce potential physical harm if bands break. Warnings material will alert users to not pull directly back. Also warnings about band damage will also alert users to examine bands after each use to avoid breakage. Damage is not completely avoidable. The thumb screws can be put back into the pipe to avoid loss. Message to secure thumb screws for child safety.

Leg Exercises

Sitting in chair of choice with apparatus directly in front can begin exercising legs by mounting device. User holding the knotted end of the band places the lower part of the band loop flat on the floor. Next user puts a foot in the lower part of the band with band at the arch of the foot. Lifting the foot and stretch band together the individual puts the knotted end of the band on the outer area of the top horizontal bar. After repeating with the other leg both legs are ready to begin exercise action. A rapid downward leg motion on the stretch band works many leg muscles. Using the imagination the operator can push down, forward, or out towards a side motion.

Legs can alternate the push down; or both legs together. These variations in the leg pushing motion works many muscles in the thigh, calf, and core. Regulating the pace (fast or slow) changes the work effort, and the effect on muscles. Apparatus activities can simulate horse back riding, skating, stair stepping, dancing, running, jogging, and hiking. Pushing feet down with heels on the floor exercises muscles in the calves. The shorter low forward facing base at a 45 degree angle holds the devise erect when not in use. Leg exercises with all gym feet on the floor requires less downward force and helps core. By pulling back on the top horizontal bar of the gym the exercise becomes more strenuous requiring more force; and will improve resistance to muscles. The pull back on the top horizontal bar also adds tension to the band. But caution is needed to never pull back too far. If the individual loses a grip of the top bar total collapsing forward is prevented when the front stability base catches the device. Smaller size bands work on the middle traverse for those who cannot be easily reach the top bar on the apparatus. The middle horizontal bar of the apparatus is a place designed for seniors, or the young. One operator sitting in a chair can exercise legs and core with stationary apparatus on four legs of said attached base; or apparatus base can be pulled back to balance on two legs at different angles.

Arm Exercises

The large low horizontal traverse base is elevated approximately 2 inches and bands can encircle under the base for multi arm exercises while feet on the otter areas hold the base down. It can be used for rowing, curls, or fast boxing. A larger six foot band can make rowing more realistic. If this longer band is held with band across inside of thighs and inward push exercises thighs. Using the 4.5 foot band another leg exercise is possible. With the knotted end of the left band crossed to the right hand, and right band crossed over to the left hands and both hands positioned outside the knees an outward push on elastic band using thighs and knees will exercise legs particularly inner thighs.

Rowing—A simulated rowing motion can be produced. Rowing exercise works arms, back, and the basic core muscles. There is also benefit to legs holding down the stationary low traverse bar.

Fast Boxing—Another exercise uses fast arm alternating upward motion to simulate a fast boxing motion. While doing this upward pulling a twisting at the waist adds exercise for body core muscles and can get heart and lungs working harder.

Thigh Exercise—When switching the knot of the elastic resistance member to opposite hands, and holding the knot on the outside of the knees while pushing knees outward results in work for the inside thighs.

Curls—Hands placed inside each loop with palms facing up; and pulling upward simulates a curl motion with weights. Band strength can be varied to simulate various weights. When pulling up, or back, on the elastic resistance member feet are placed on the lower horizontal bars to keep the devise firmly on the floor.

Optional longer elastic resistance member (7' or longer) can be used to simulate the upward push of other exercise devices. This device has many uses. When there is bad weather (rain, cold, snow, ice) the apparatus indoors is a substitute for outdoor exercise. Stretching on the apparatus before or after a run, or walk can help to warm up or cool down.

What is claimed is:

1. A triangle shaped functional multi-exercise apparatus for sitting individuals, said apparatus comprising:

a main framework having a horizontal traverse support base with distal ends terminating in two ninety degree ells with associated rubber feet, said horizontal traverse support base further includes two tee base parts with elongated connecting pipes that each include an imbedded plug at one end and further terminates at respective tee base parts associated with a middle horizontal traverse;

each tee base part associated with said middle horizontal traverse further includes a one end receiving a pipe with a cap and another end connected to a single 4way middle connector;

said 4way middle connector further includes one end connected to a forty-five degree ell with an embedded plug associated therewith, said forty-five degree ell further includes an elongated connecting pipe connected thereto that terminates at a middle tee, said middle tee further includes two connecting pipes that each terminate with ninety degree ells with associated rubber feet;

said 4way middle connector further includes an end connected to a pipe with an associated imbedded plug, said pipe terminates at a 4way single vertical part associated with an elevated horizontal traverse, said 4way single vertical part further includes ends connected to ninety degree ells with ends connected to pipes with associate caps;

wherein the apparatus is primarily made up of PVC (polyvinyl chloride) and the imbedded plugs are made up of solid PVC so as to add rigidity to the apparatus;

wherein the apparatus is further usable in combination with at least one of a plurality of different elastic stretch rubber bands connectable to the apparatus at points associated with each cap; and wherein each of the elongated connecting pipes are arranged to be disposed at forty-five degrees with respect to a rigid horizontal supporting surface in which the apparatus would be rested upon during use.

2. A functional triangle shaped multi-exercise apparatus as described in claim 1, wherein said rubber bands encircling said functional triangular apparatus at predetermined locations whereby the apparatus can be used either stationary, or tilted back to balance on the rubber feet of the horizontal traverse support base such that a user can exercise upper extremities while being seated in a chair.

* * * * *